US007429960B2

(12) United States Patent
Horiki et al.

(10) Patent No.: US 7,429,960 B2
(45) Date of Patent: Sep. 30, 2008

(54) LOG-PERIODIC ANTENNA

(75) Inventors: Yasutaka Horiki, Ypsilanti, MI (US); Charles Reimer, Adrian, MI (US)

(73) Assignee: AGC Automotive Americas R & D, Inc., Ypsilanti, MI (US)

( * ) Notice: Subject to any disclaimer, the term of this patent is extended or adjusted under 35 U.S.C. 154(b) by 86 days.

(21) Appl. No.: 11/412,572

(22) Filed: Apr. 27, 2006

(65) Prior Publication Data

US 2007/0252769 A1 Nov. 1, 2007

(51) Int. Cl.
*H01Q 11/10* (2006.01)

(52) U.S. Cl. ..... 343/792.5; 343/810

(58) Field of Classification Search ..... 343/792.5, 343/810, 876, 877, 880
See application file for complete search history.

(56) References Cited

U.S. PATENT DOCUMENTS

| | | | | |
|---|---|---|---|---|
| 3,573,839 | A | 4/1971 | Parker, Jr. | |
| 3,599,217 | A | 8/1971 | Grant | |
| 3,697,999 | A | 10/1972 | Cory et al. | |
| 4,262,293 | A | 4/1981 | Parmer | |
| 4,460,895 | A | 7/1984 | Bert et al. | |
| 4,977,408 | A * | 12/1990 | Harper et al. | 343/792.5 |
| 5,103,238 | A | 4/1992 | Mahnad | |
| 5,196,858 | A * | 3/1993 | Reed | 343/900 |
| 5,214,439 | A | 5/1993 | Reed | |
| 5,517,206 | A | 5/1996 | Boone et al. | |
| 5,790,082 | A | 8/1998 | Podger | |
| 5,886,672 | A * | 3/1999 | Brune et al. | 343/792.5 |
| 5,917,455 | A * | 6/1999 | Huynh et al. | 343/792.5 |
| 5,995,060 | A * | 11/1999 | Podger | 343/807 |
| 6,278,414 | B1 | 8/2001 | Filipovic | |
| 6,839,038 | B2 | 1/2005 | Weinstein | |
| 6,842,156 | B2 | 1/2005 | Shepherd et al. | |
| 6,930,649 | B1 | 8/2005 | Sergi | |
| 7,030,829 | B1 * | 4/2006 | McLean | 343/792.5 |
| 2004/0017324 | A1 | 1/2004 | Engargiola | |
| 2004/0075615 | A1 | 4/2004 | Engargiola et al. | |

FOREIGN PATENT DOCUMENTS

| | | |
|---|---|---|
| WO | WO 94/21006 | 9/1994 |

* cited by examiner

*Primary Examiner*—Tho G Phan
(74) *Attorney, Agent, or Firm*—Howard & Howard Attorneys, P.C.

(57) ABSTRACT

The subject invention provides a log-periodic antenna and method for controlling multiple polarizations of the antenna per a given frequency or frequencies The antenna includes a boom and a plurality of pairs of elements where each element of each pair of elements extends laterally from the boom in opposite directions. The plurality of pairs of elements includes a first pair of elements disposed in a first plane with the boom and a second pair of elements disposed in a second plane with the boom. The first plane extends radially from the boom at a first radial angle and the second plane extends radially from the boom at a second radial angle. The first radial angle is offset to the second radial angle. The antenna may include at least one adjustment mechanism. Each adjustment mechanism allows angular adjustment of at least one of the elements for controlling the multiple polarizations of the antenna.

19 Claims, 8 Drawing Sheets

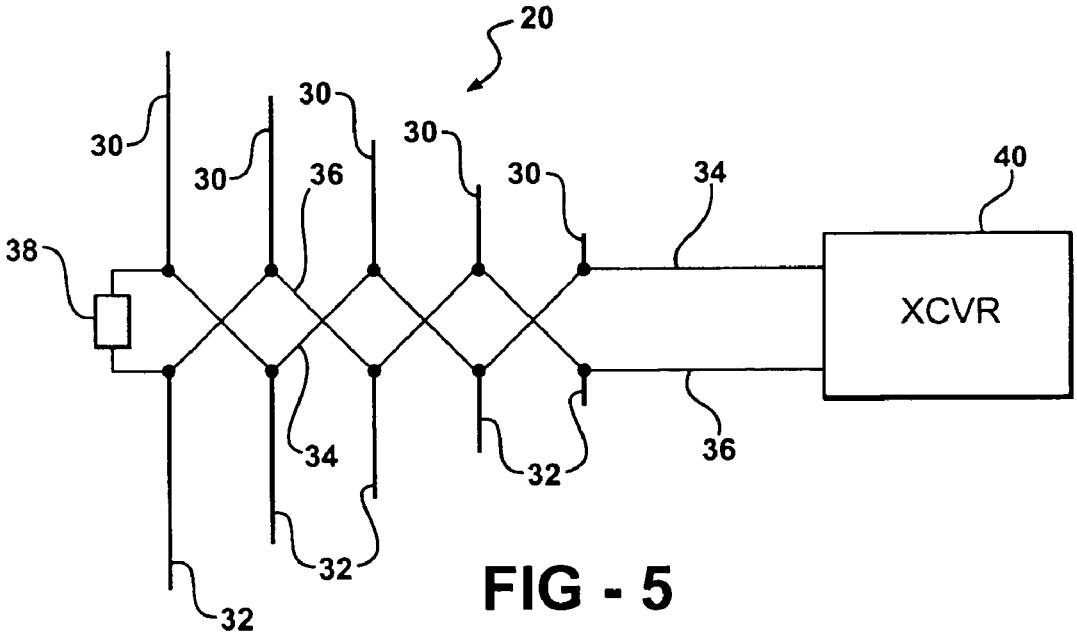
FIG - 5
FIG - 10
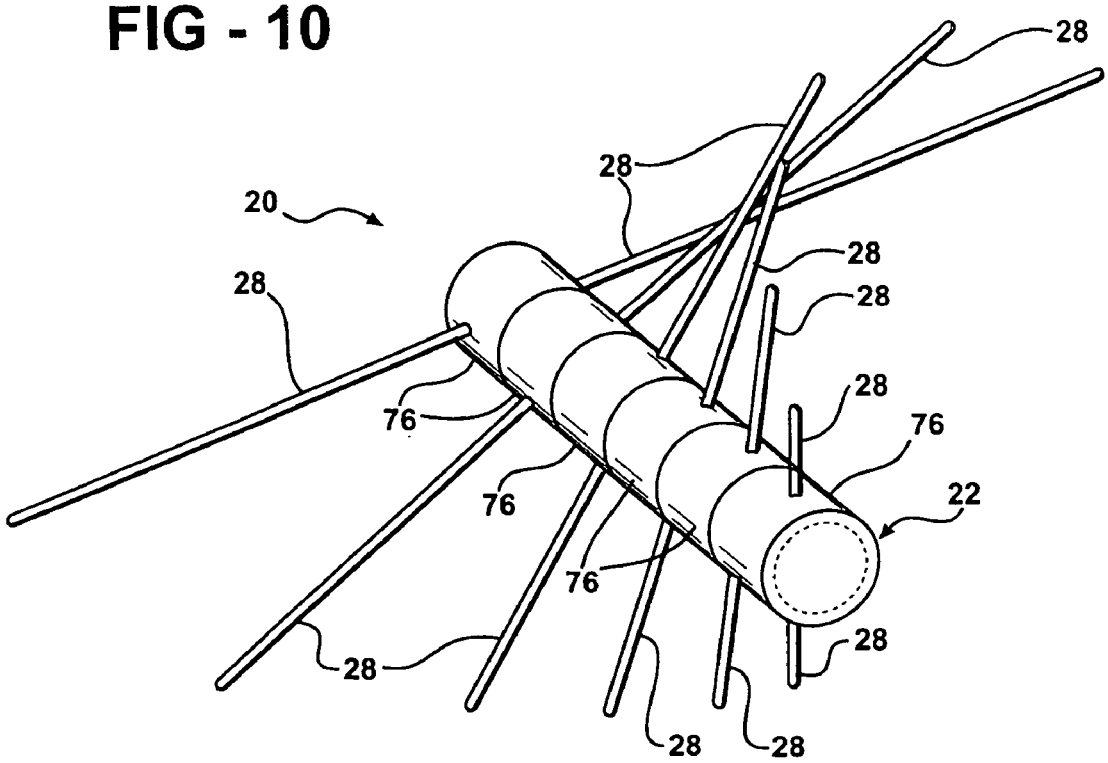

LOG-PERIODIC ANTENNA

BACKGROUND OF THE INVENTION

1. Field of the Invention

The subject invention relates generally to an antenna. Specifically, the subject invention relates to a frequency-independent broadband antenna, such as a log-periodic antenna, for use in a testing environment.

2. Description of the Related Art

Antenna testing is a necessary step in the process of antenna design and development. The need for comprehensive testing is even more pronounced when testing receiving antennas for vehicles due to the mobility of the receiving antenna and the potential interference caused by vehicle electronic systems, etc.

To accomplish this testing, a transmitting antenna, such as a log-periodic antenna, is used to radiate a radio frequency (RF) signal. The RF signal is received by the receiving antenna and is measured by test equipment. One objective in such testing is to expose the receiving antenna to multiple polarizations across a test frequency range. Vehicle manufacturers and suppliers typically utilize open-site environments and anechoic chambers (i.e., a shielded test environment) to perform this testing. When utilizing an open site environment, the transmitting antenna may be induced to provide multiple polarizations across a test frequency range by changing an overall axis angle of the entire transmitting antenna. However, providing multiple polarizations over the test frequency range is difficult in anechoic chambers since typical anechoic chambers utilize a frequency-sweep field-transmitting system that cannot radiate multiple polarizations by changing the axis angle. Therefore, there is a need for an antenna for providing multiple polarizations over the test frequency range in anechoic chambers or other shielded test environments.

Log-periodic antennas are well known in the prior art. One such antenna is disclosed in U.S. Pat. No. 6,842,156 (the '156 patent). The '156 patent discloses an antenna having a boom extending longitudinally from a front end to a rear end. The antenna also includes a plurality of pairs of elements spaced longitudinally along the boom. The pairs of elements extend laterally from the boom in opposite directions. The length of each element increases from the front end to the rear end of the boom. Spacing between the elements also increases from the front end to the rear end. Several of the longer elements include an outer portion which is bent toward the front end of the antenna. Although several outer portions are bent, the elements remain substantially coplanar. Because the elements are coplanar, the polarization of each frequency is substantially identical and is determined by the overall axis position of the antenna. Unfortunately, the antenna of the '156 patent does not provide the ability to provide multiple polarizations over the test frequency range. Therefore, the antenna of the '156 patent would not be ideal for use in an anechoic chamber to provide multiple polarizations of a test frequency range.

Thus, there remains a need for an antenna and method for providing multiple polarizations over a test frequency range in anechoic chamber and other shielded testing environments.

SUMMARY OF THE INVENTION AND ADVANTAGES

The subject invention provides a log-periodic antenna including a boom extending longitudinally and a plurality of pairs of elements spaced longitudinally along the boom. Each of the pairs of elements extends laterally from the boom in opposite directions. The plurality of pairs of elements includes a first pair of elements and a second pair of elements. The first pair of elements is disposed in a first plane with the boom with the first plane extending radially from the boom at a first radial angle. The second pair of elements is disposed in a second plane with the boom with the second plane extending radially from the boom at a second radial angle. The first radial angle is offset to the second radial angle.

The subject invention also provides a log-periodic antenna, in an alternative embodiment, having at least one adjustment mechanism. Each adjustment mechanism supports at least one of the elements for allowing angular adjustment of the at least one of the elements.

The subject invention further provides a method of controlling a polarization of a log-periodic antenna. The antenna includes a boom extending longitudinally and a plurality of pairs of elements spaced longitudinally along the boom. Each of the pairs of elements extends laterally from the boom in opposite directions. The plurality of pairs of elements includes a first pair of elements and a second pair of elements. The first pair of elements is disposed in a first plane with the boom and the first plane extends radially from the boom at a first radial angle. The second pair of elements is disposed in a second plane with the boom and the second plane extends radially from the boom at a second radial angle. The antenna further includes at least one adjustment mechanism. Each adjustment mechanism supports at least one of the elements for allowing angular adjustment of the at least one of the elements. The method comprising the step of adjusting at least one of the pairs of elements with the adjustment mechanism such that the first radial angle is offset to the second radial angle.

The antennas and method described above may provide multiple polarizations per a given frequency or frequencies. The antenna and method are particularly suited for use in an anechoic chamber that utilizes a frequency-sweep field-transmitting system where all RF signals are sent at once. Therefore, the antenna and method of the subject invention may be used to produce results similar to anechoic and open-site testing environments where an axis angle of a transmitting antenna is changed for each frequency being tested.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is an electrical schematic of the log-periodic antenna electrically connected to a transceiver;

FIG. 10 is a perspective view of a third embodiment of the log-periodic antenna having rotatable sections of a boom as the adjustment mechanisms.

DETAILED DESCRIPTION OF THE INVENTION

Referring to the Figures, wherein like numerals indicate corresponding parts throughout the several views, a log-periodic antenna is generally shown at 20.

The log-periodic antenna 20 described herein is designed primarily for transmitting radio frequency (RF) signals (i.e., radio waves) in an anechoic chamber environment. However, those skilled in the art realize that the antenna 20 may also be used to receive RF signals and may be used outside of the anechoic chamber environment.

Figure 1:
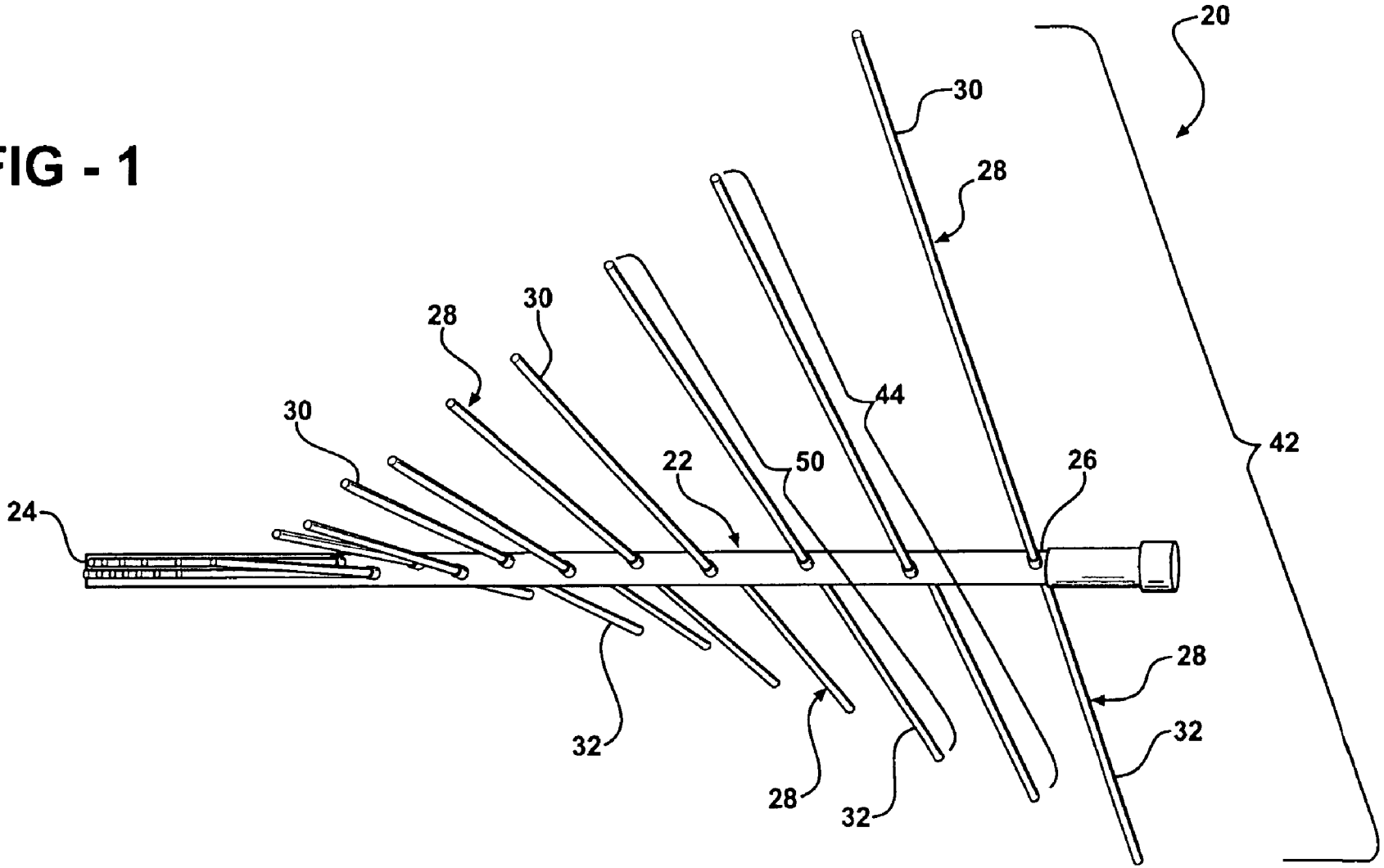
FIG. 1 is a side perspective view of a first embodiment of a log-periodic antenna.

Referring to FIG. 1, the antenna 20 includes a boom 22. The boom 22 extends longitudinally from a front end 24 to a rear end 26. The boom 22 may be formed of any structurally strong material. This boom 22 is typically formed from a non-conductive material. In a first embodiment, the boom 22 is formed of a fiber reinforced polymer (FRP) and has a rectangular cross-section which defines a hollow center.

In other embodiments, the boom may be solid, or filled with a dielectric material to hide circuitry and to enhance the structural strength of the boom. Also, as is detailed below, the boom 22 may have a circular cross-section. Of course, those skilled in the art realize alternative shapes, styles, and materials of construction for the boom 22.

The antenna 20 includes a plurality of pairs of elements 28. Each element 28 is formed of a conductive material, such as metal, to transmit and/or receive RF signals. The conductive material is preferably a lightweight metal, such as aluminum. However, those skilled in the art realize other conductive materials that may be effectively used. Preferably, each element 28 is straight, i.e, rod-shaped. However, other configurations for the elements 28 may be implemented, including, but not limited to, bent bow-tie shapes, circular shapes, or ovular shapes.

Each of the pairs of elements 28 includes a first element 30 and a second element 32. The first and second elements 30, 32 extend laterally from the boom 22 in opposite directions as dipole pairs. Preferably, the first and second elements 30, 32 are aligned with one another on opposite sides of the boom 22. However, the first and second elements 30, 32 may be offset (i.e., not aligned) from one another. The elements 28 may project directly from the sides of the boom 22. Alternatively, the elements 28 may be suspended from the boom 22, i.e., raised above or hanging below the boom 22.

The pairs of elements 28 are spaced longitudinally along the boom 22 between the front end 24 and the rear end 26. The spacing between the pairs of elements 28 increases from the front end 24 to the rear end 26. Each pair of elements 28 defines a length corresponding to a frequency or range of frequencies. The lengths of the pairs of elements 28 increase from the front end 24 to the rear end 26. With the plurality of pairs of elements 28 having various lengths, the antenna 20 may operate over a wide range of frequencies.

In one embodiment, where the antenna is used in the anechoic chamber environment, each element 28 of the first eight pairs of elements 28 (starting from the rear end 26) measure about 1010 mm, 900 mm, 800 mm, 710 mm, 630 mm, 560 mm, 500 mm, and 440 mm. These lengths correspond to the test frequencies that are being applied and measured in the anechoic chamber. Of course, in alternate embodiments, the lengths of the elements 28 are designed based on the frequencies that are desired to be transmitted or received.

For purposes of clarity and description, all of the first elements 30 are disposed on one side of the boom 22, while all of the second elements 32 are disposed on the other side of the boom 22. Referring now to FIG. 5, the antenna 20 further includes a first conductor 34 electrically connecting the first and second elements 30, 32 of adjacent pairs of elements 28 in an alternating fashion. Said another way, the first conductor 34 "zigzags" between adjacent first and second elements 30, 32. A second conductor 36 electrically connects the second and first elements 32, 30 of adjacent pairs of elements 28 not connected to the first conductor 34 in an alternating fashion. These alternating electrical connections allow each element 28 to be driven with a 180° phase shift. However, those skilled in the art realize other techniques to achieve the 180° phase shift.

At the rear end 26 of the boom 22, following the electrical connection of the longest elements 28, the first and second conductors 34, 36 are connected to an impedance stub 38. At the front end 24 of the boom 22, following the electrical connection of the shortest elements 28, the first and second conductors 34, 36 are electrically connected to a transceiver 40. Those skilled in the art realize that the transceiver 40 can be substituted for a transmitter and/or a receiver. Furthermore, those skilled in the art realize that the first and second conductors 34, 36 can be connected to a balun (not shown) for allowing a coaxial cable (not shown) to connect the antenna 20 to the transceiver 40.

Figure 2:
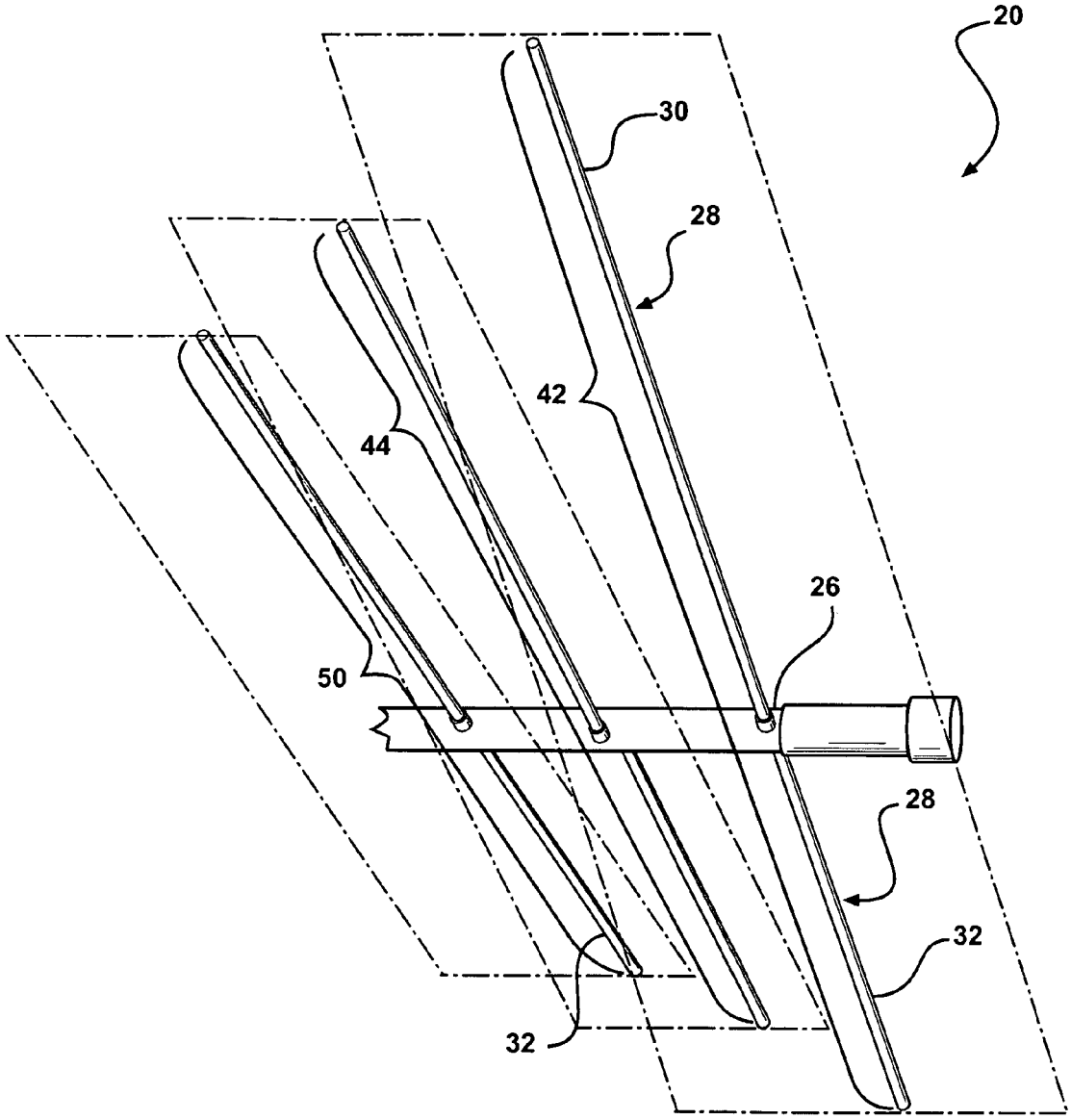
FIG. 2 is a side perspective view of the first embodiment showing first, second, and third pairs of elements and corresponding first, second, and third planes.
Figure 3:
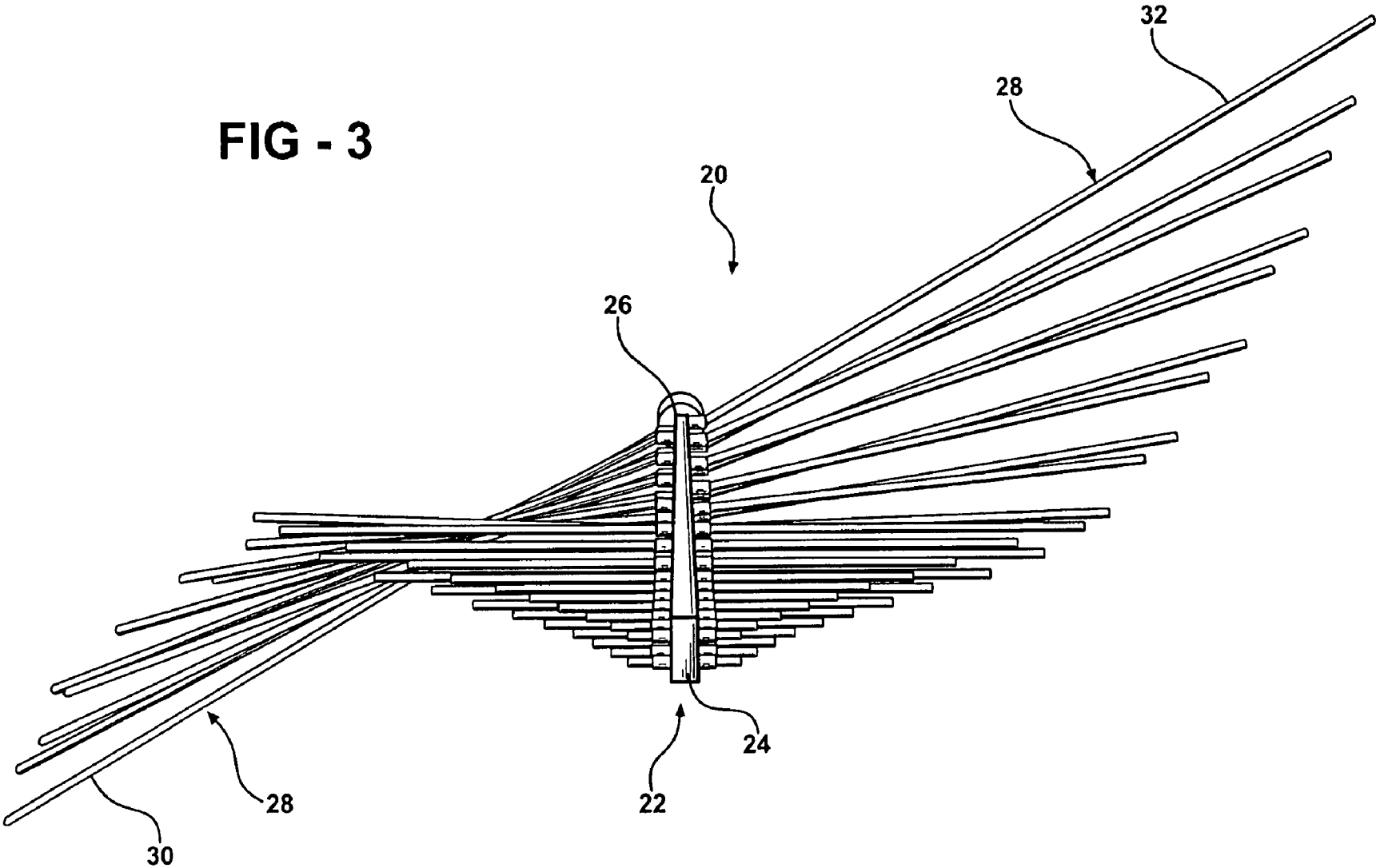
FIG. 3 is a front perspective view of the first embodiment of the log-periodic antenna.
Figure 4:
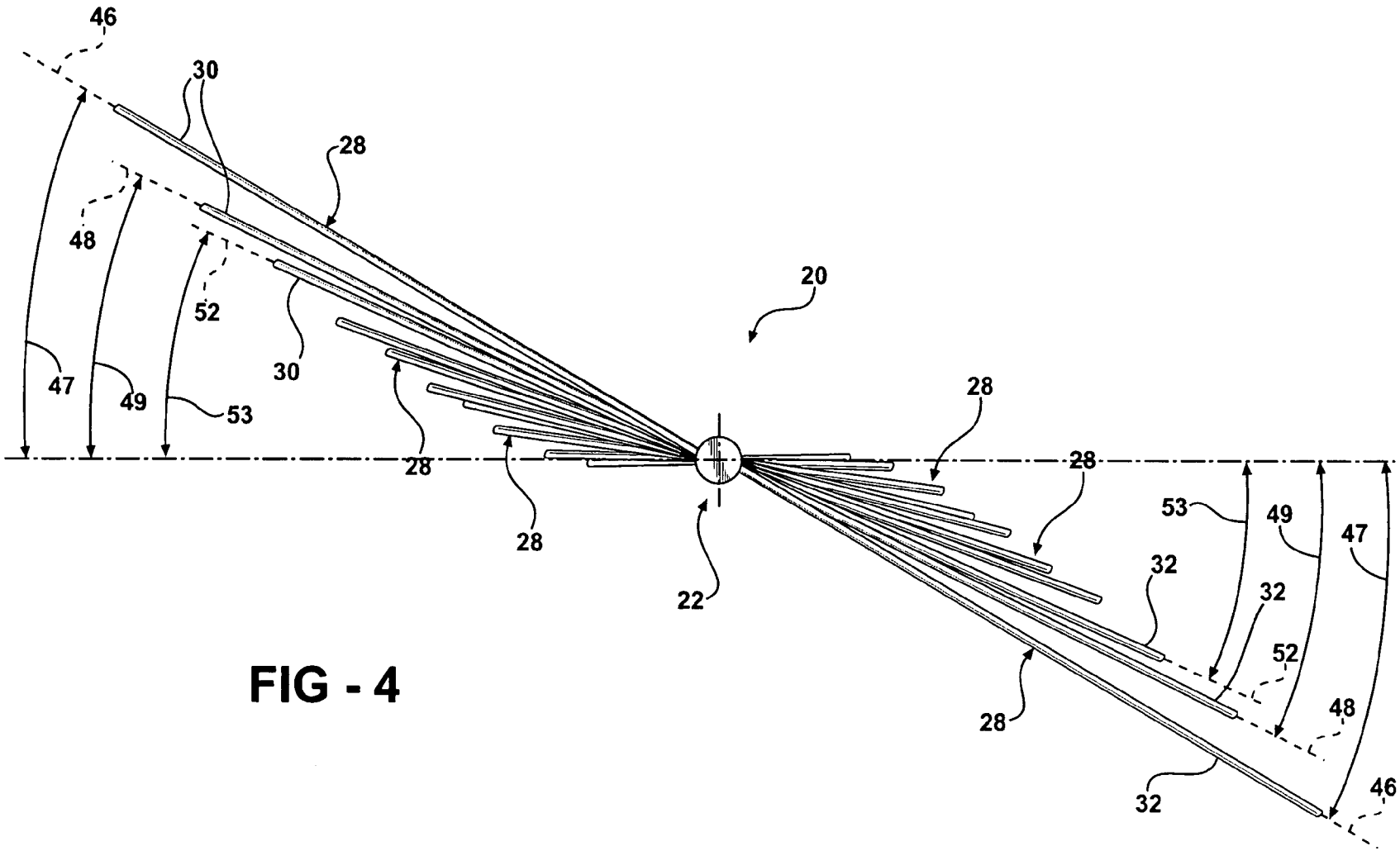
FIG. 4 is a rear view of the first embodiment of the log-periodic antenna.

Referring now to FIG. 2, the plurality of pairs of elements 28 includes a first pair of elements 42 and a second pair of elements 44. The first pair of elements 42 is disposed in a first plane 46 with the boom 22. The second pair of elements 44 is disposed in a second plane 48 with the boom 22. Referring now to FIG. 4, the first and second planes 46, 48 are shown cross-sectionally and represented as dotted lines. The first plane 46 extends radially from the boom 22 at a first radial angle 47. The second plane 48 extends radially from the boom 22 at a second radial angle 49. The first radial angle 47 is offset from the second radial angle 49. Said another way, the first plane 46 is non-parallel to the second plane 48. Said yet another way, the first pair of elements 42 is "twisted", or askew, with respect to the second pair of elements 44.

In typical prior art log-periodic antennas, the polarization of each frequency is substantially identical and is determined by the position of the entire antenna 20. However, the radial offset of the first plane 46 to the second plane 48 in the present invention alters the polarization of the antenna 20 among the various frequencies served by the antenna 20. The antenna 20 of the present invention may sacrifice gain in certain polarizations with this "twisted" element concept. However, the antenna 20 provides multiple polarizations per a given frequency or frequencies. Furthermore, the antenna will not sacrifice total gain or result in a reduction of transmitted power.

Additional pairs of elements 28 of the plurality of pairs of elements 28 may also be disposed radially offset from the first and second pair of elements 42, 44. For example, the plurality of pairs of elements 28 may further include a third pair of elements 50 disposed in a third plane 52 with the boom 22. The third plane 52 extends radially from the boom 22 at a third radial angle 53 offset to the first and second radial angles 47, 49 of the first and second planes 46, 48.

The first, second, and third pairs of elements 42, 44, 50 are shown in FIGS. 1 and 2 as the first three pairs of elements 28 starting from the rear end 26 of the boom 22. However, the first, second, and third pairs of elements 42, 44, 50 could be any of the plurality of pairs of elements 28 of the antenna 20. Furthermore, the first, second, and third pairs of elements 42, 44, 50 need not be adjacent to each other.

In the first embodiment of the antenna, the elements 28 are permanently affixed in their positions, as is shown in FIGS. 1-4. However, it may be desirable that the antenna 20 include at least one adjustment mechanism 54 supporting at least one of the elements 28. The adjustment mechanism 54 allows angular adjustment of at least one of the elements 28 to change the polarization of a frequency or range of frequencies.

Figure 6:
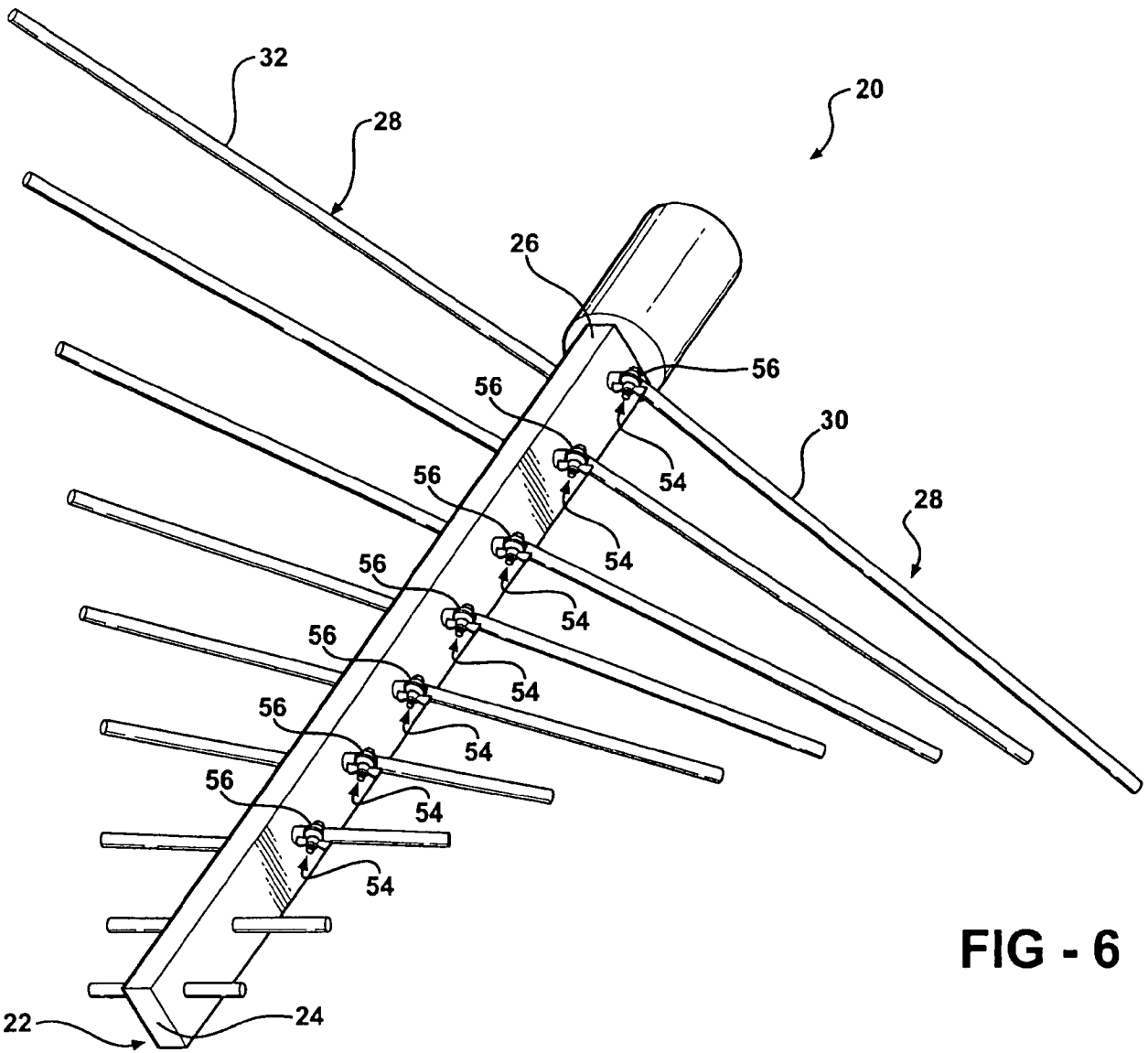
FIG. 6 is a perspective view a second embodiment of the log-periodic antenna having hinges as adjustment mechanisms.

In a second embodiment, as seen in FIG. 6, the adjustment mechanism 54 is further defined as at least one hinge 56 operatively connecting at least one of the elements 28 to the boom 22. However, it is preferred that the adjustment mechanism 54 include a plurality of hinges 56 with each hinge 56 operatively connecting one of the elements 28 to the boom 22. The hinges 56 allow angular adjustment of the elements 28 with respect to other elements 28. It is preferable that the hinge be formed of a lightweight, electrically conductive material.

Figure 7:
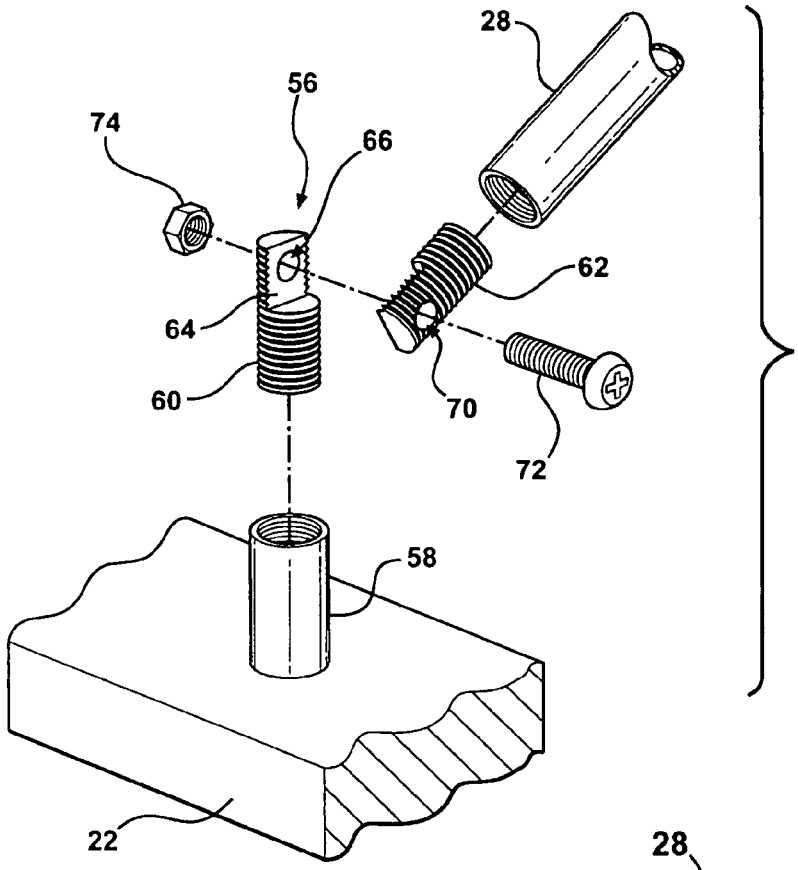
FIG. 7 is an exploded view of one the hinges utilizing a standard nut and bolt combination.
Figure 8:
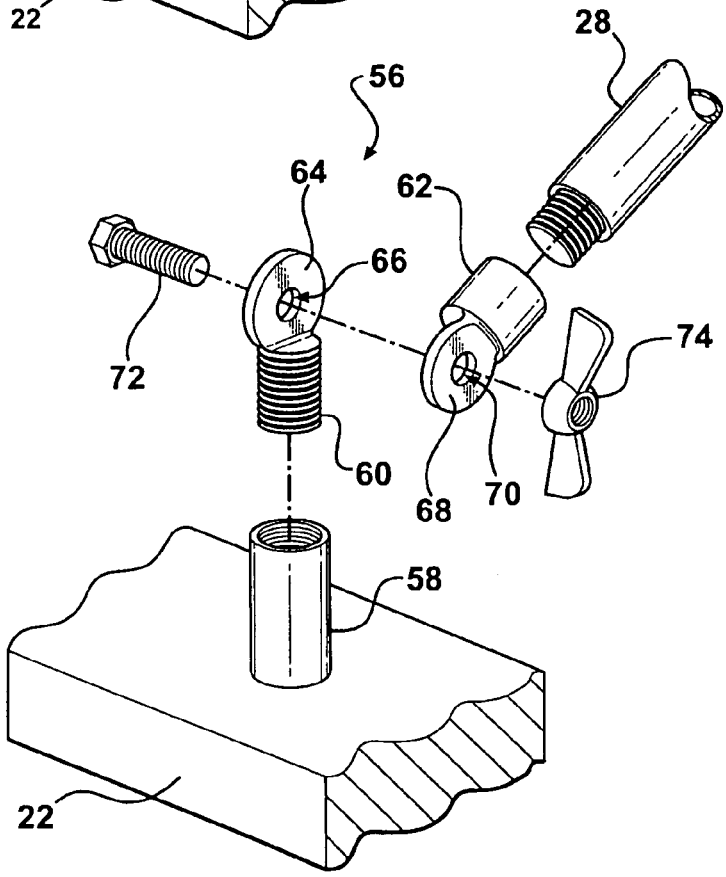
FIG. 8 is an exploded view of one of the hinges utilizing a wing nut and bolt combination.
Figure 9:
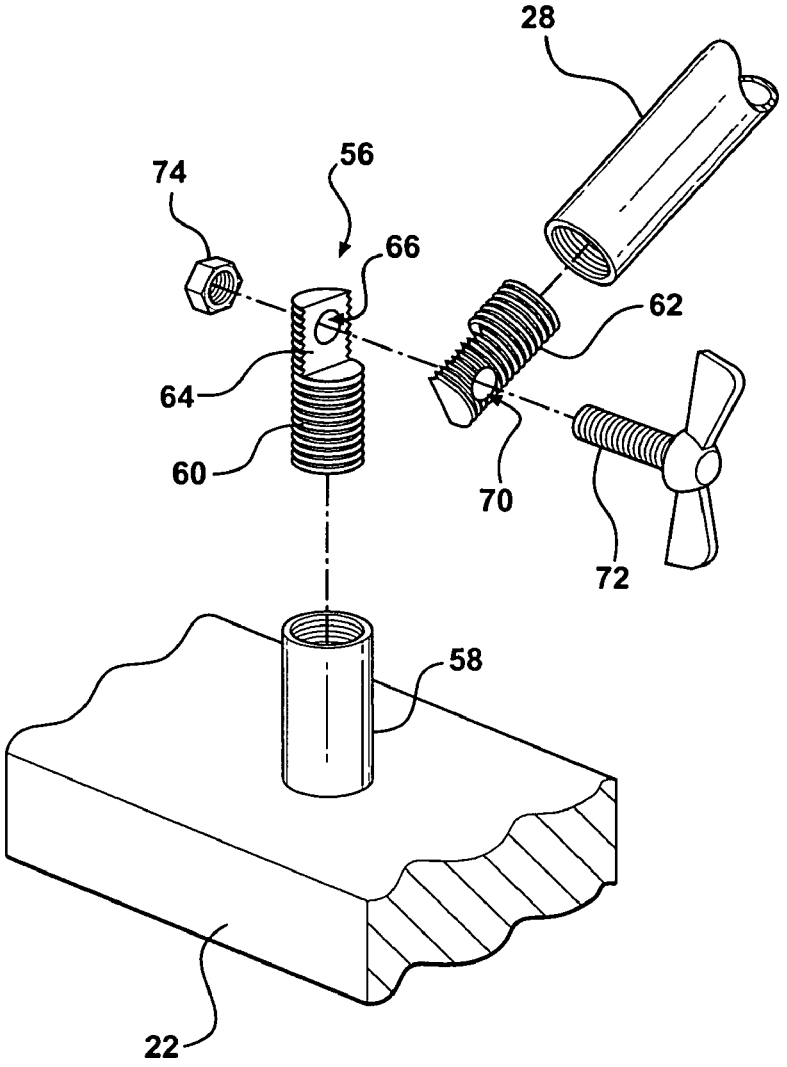
FIG. 9 is an exploded view of one of the hinges utilizing a wing bolt and nut combination.

Referring now to FIGS. 7-9, each hinge 56 preferably includes a stub portion 58 supported by the boom 22. More preferably, the stub portions 58 project directly from the sides of the boom 22. The stub portions 58 may be formed of a non-conductive material to electrically insulate the elements 28 from the boom 22.

Each hinge 56 also includes a first part 60 connected to the stub portion 58 and a second part 62 connected to the element 28. The first part 60 includes a first flat surface 64 and defines a first hole 66 disposed through the first flat surface 64. The second part 62 includes a second flat surface 68 overlying the first flat surface 64. The second part 62 also defines a second hole 70 disposed through the second flat surface 68. The second hole 70 is aligned with the first hole 66. The hinge 56 further preferably includes a threaded bolt 72 disposed through the first and second holes 66, 70 and a nut 74 attached to the threaded bolt 72 for securing the first and second parts 60, 62 together. The threaded bolt 72 may be a standard-type bolt, as shown in FIG. 7, requiring tools such as a screwdriver or wrench to tighten or loosen the threaded bolt 72 and nut 74. Alternatively, as seen in FIGS. 8 and 9, the threaded bolt 72 or the nut 74 may include wings for hand loosening or tightening without tools.

In a third embodiment, as shown in FIG. 10, the adjustment mechanism 54 is implemented by the boom 22 being divided into a plurality of sections 76. Said simply, the adjustment mechanism 54 is the plurality of sections 76. At least two adjacent sections 76 rotatably interface with one another. One pair of the plurality of pairs of elements 28 is supported by each section 76 for allowing angular adjustment of the one of the elements 28. The third embodiment also ensures that the each element 28 of each pair of elements 28 stays aligned (i.e., in the same plane) with one another.

The subject invention also provides a method of controlling the polarization of the log-periodic antenna 20. The method comprises the step of adjusting at least one of the pairs of elements 28 with the adjustment mechanism 54 such that the radial angle 47 is offset to the second radial angle 49.

In the second embodiment, where the adjustment mechanism 54 is implemented as at least one hinge 56, the step of adjusting at least one of the pairs of elements 28 with the adjustment mechanism 54 is further defined as operating the hinge 56 to adjust at least one of the pairs of elements 28 such that the first radial angle 47 is offset to the second radial angle 49. In the third embodiment, where the adjustment mechanism 54 is implemented as the boom 22 divided into a plurality of sections 76, the step of adjusting at least one of the pairs of elements 28 is further defined as rotating one of the sections 76 to adjust at least one of the pairs of elements 28.

Obviously, many modifications and variations of the present invention are possible in light of the above teachings. The invention may be practiced otherwise than as specifically described within the scope of the appended claims.

What is claimed is:

1. A log-periodic antenna comprising;

a boom extending longitudinally, a plurality of pairs of elements spaced longitudinally along said boom with each of said pairs of elements extending laterally from said boom in opposite directions, said plurality of pairs of elements including a first pair of elements, a second pair of elements, and a third pair of elements, said first pair of elements disposed in a first plane with said boom with said first plane extending radially from said boom at a first radial angle, said second pair of elements disposed in a second plane with said boom with said second plane extending radially from said boom at a second radial angle which is offset relative to said first radial angle, and said third pair of elements disposed in a third plane with said boom and said third plane extending radially from said boom at a third radial angle which is offset to said first and second radial angles.

2. An antenna as set forth in claim 1 further comprising a plurality of hinges with each hinge operatively connecting one of said elements to said boom for allowing angular adjustment of said one of said elements.

3. An antenna as set forth in claim 1 wherein said boom comprises a plurality of sections rotatably interfacing with one another wherein one pair of said plurality of pairs of elements is supported by each section.

4. An antenna as set forth in claim 1 wherein said boom extends longitudinally from a front end to a rear end and lengths defined by said pairs of elements increase from said front end to said rear end.

5. An antenna as set forth in claim 4 wherein a spacing between said pairs of elements increases from said front end to said rear end.

6. A log-periodic antenna comprising;

a boom extending longitudinally, a plurality of pairs of elements spaced longitudinally along said boom with each of said pairs of elements extending laterally from said boom in opposite directions, said plurality of pairs of elements including a first pair of elements and a second pair of elements, said first pair of elements disposed in a first plane with said boom with said first plane extending radially from said boom at a first radial angle, said second pair of elements disposed in a second plane with said boom with said second plane extending radially from said boom at a second radial angle which is offset relative to said first radial angle, and wherein each of said pairs of elements includes a first element and a second element and said antenna further comprises a first conductor electrically connecting said first and second elements of adjacent pairs of elements in an alternating fashion and a second conductor electrically connecting said second and first elements of adjacent pairs of elements not connected to said first conductor in an alternating fashion.

7. An antenna as set forth in claim 6 further comprising a plurality of hinges with each hinge operatively connecting one of said elements to said boom for allowing angular adjustment of said one of said elements.

8. An antenna as set forth in claim 6 wherein said boom comprises a plurality of sections rotatably interfacing with one another wherein one pair of said plurality of pairs of elements is supported by each section.

9. An antenna as set forth in claim 6 wherein said boom extends longitudinally from a front end to a rear end and lengths defined by said pairs of elements increase from said front end to said rear end.

10. An antenna as set forth in claim 9 wherein a spacing between said pairs of elements increases from said front end to said rear end.

11. A log-periodic antenna comprising;

a boom extending longitudinally, a plurality of pairs of elements spaced longitudinally along said boom with each of said pair of elements extending laterally from said boom in opposite directions, wherein each of said pairs of elements includes a first element and a second element and said antenna further comprises a first conductor electrically connecting said first and second elements of adjacent pairs of elements in an alternating fashion and a second conductor electrically connecting said second and first elements of adjacent pairs of elements not connected to said first conductor in an alternating fashion, and at least one adjustment mechanism with said adjustment mechanism supporting at least one of said elements for allowing angular adjustment of said at least one of said elements.

12. An antenna as set forth in claim 11 wherein said plurality of pairs of elements includes a first pair of elements disposed in a first plane with said boom and said first plane extends radially from said boom at a first radial angle, a second pair of elements disposed in a second plane with said boom with said second plane extending radially from said boom at a second radial angle which is offset to said first radial angle.

13. An antenna as set forth in claim 11 wherein said adjustment mechanism is further defined as a hinge operatively connecting one of said elements to said boom for allowing angular adjustment of said one of said elements.

14. An antenna as set forth in claim 11 wherein said adjustment mechanism is further defined as said boom divided into a plurality of sections rotatably interfacing with one another wherein one pair of said plurality of pairs of elements supported by each section for allowing angular adjustment of said one of said elements.

15. An antenna as set forth in claim 11 wherein said boom extends longitudinally from a front end to a rear end and lengths of said elements increase from said front end to said rear end.

16. An antenna as set forth in claim 15 wherein spacing between said pairs of elements increases from said front end to said rear end.

17. A method of controlling a polarization of a log-periodic antenna having a boom extending longitudinally, a plurality of pairs of elements spaced longitudinally along the boom with each of the pair of elements extending laterally from the boom in opposite directions, the plurality of pairs of elements including a first pair of elements and a second pair of elements, the first pair of elements disposed in a first plane with the boom and the first plane extending from the boom at a first radial angle, the second pair of elements disposed in a second plane with the boom and the second plane extending from the boom at a second radial angle, and at least one adjustment mechanism with the adjustment mechanism supporting at least one of the elements for allowing angular adjustment of the at least one of the elements, the method comprising the step of:

adjusting at least one of the pairs of elements with the adjustment mechanism such that the first radial angle is offset to the second radial angle.

18. A method as set forth in claim 17 wherein the adjustment mechanism is further defined as a hinge operatively connecting one of the elements to the boom and wherein said step of adjusting at least one of the pairs of elements with the adjustment mechanism is further defined as manipulating the hinge to adjust at least one of the pairs of elements such that the first radial angle is offset to the second radial angle.

19. A method as set forth in claim 17 wherein the adjustment mechanism is further defined as the boom divided into a plurality of sections rotatably interfacing with one another wherein one pair of the plurality of pairs of elements is supported by each section and wherein said step of adjusting at least one of said pairs of elements with the adjustment mechanism is further defined as rotating one of the sections to adjust at least one of the pairs of elements such that the first radial angle is offset to the second radial angle.

* * * * *